United States Patent [19]

Neelameggham et al.

[11] Patent Number: 4,579,166

[45] Date of Patent: Apr. 1, 1986

[54] MAGNESIUM ALLOY CASTING IN PLASTER MOLDS

[75] Inventors: Ramaswami Neelameggham, Salt Lake City; Owen K. Wheeler, Tooele; Grant B. Weed, Bountiful, all of Utah

[73] Assignee: Amax Inc., Greenwich, Conn.

[21] Appl. No.: 598,710

[22] Filed: Apr. 10, 1984

[51] Int. Cl.[4] ..... B22D 46/00

[52] U.S. Cl. ..... 164/458; 164/67.1; 164/529

[58] Field of Search ..... 164/61, 65, 253, 255, 164/524, 529, 150, 154, 4.1, 259, 66.1, 67.1, 458

[56] References Cited

U.S. PATENT DOCUMENTS 3,400,752 9/1968 Unsworth ..... 164/66.1

FOREIGN PATENT DOCUMENTS 0065841 12/1982 European Pat. Off. ..... 164/150

53-12726 2/1978 Japan ..... 164/66.1

*Primary Examiner*—Nicholas P. Godici

*Attorney, Agent, or Firm*—Michael A. Ciomek; Eugene J. Kalil

[57] ABSTRACT

Magnesium and magnesium alloy castings are produced using porous, calcined plaster of Paris molds by filling the mold cavity and the pores communicating therewith with a pressurized inhibitor gas comprising sulfur hexafluoride and monitoring temperature conditions during cooling of the cast metal using a thermocouple placed in the mold close to the sprue whereby, in the event of an exotherm as indicated by non-decreasing temperature, the mold may be broken to prevent an explosion.

5 Claims, No Drawings

MAGNESIUM ALLOY CASTING IN PLASTER MOLDS

The invention is directed to the casting of magnesium and magnesium alloys in plaster molds.

BACKGROUND OF THE INVENTION AND THE PRIOR ART

As noted in the article entitled "Plaster Molding For Precision Castings" by Dave Kanicki, which appeared in MODERN CASTING, MAX 1978, the plaster mold process is a quick and economical means for the production of prototype castings in small volume. In the manufacture and testing of new machinery designs, the process is valuable in that experimental devices can be produced and tested while avoiding the massive tooling costs which would otherwise be encountered if other production routes such as die-casting were resorted to so that the required parts could be obtained. The process works well for the production of castings made of aluminum and zinc and their alloys. However, in the case of magnesium and magnesium alloys, the reactivity of the metal is so great that explosions result when it is attempted to produce castings thereof in the kinds of plaster molds which can successfully be employed to produce aluminum and zinc castings.

U.S. Pat. Nos. 2,529,835 and 2,754,220 are directed to the production of permeable plaster of Paris molds wherein gypsum ($CaSO_4 \cdot \frac{1}{2} H_2O$) plaster is mixed with foam and other additives to produce a fine pore structure within the molds which may then be heated to the extent of calcination of the calcium sulfate hemihydrate. Such a calcination procedure is not viewed favorably in the patents. The use of sulfur hexafluoride ($SF_6$) as a mold purge in the production of magnesium castings has been known.

BRIEF SUMMARY OF THE INVENTION

The invention is directed to the production of plaster molds, calcination of the molds to remove both uncombined and combined water and to leave a system of interconnected pores in the mold walls, impregnation of at least the pores adjacent the mold cavity with pressurized gas having sulfur hexafluoride as the principal inhibiting agent and pouring molten magnesium or magnesium alloy into the mold cavity to form a casting without producing explosions. The invention also contemplates, as an essential safety feature, providing temperature responsive means such as a thermocouple inserted in the mold close to the sprue and monitoring temperature during cooling of the casting whereby if the temperature undergoes an exotherm, indicated by a non-decreasing temperature, during cooling of the casting, the mold is broken to prevent an explosion.

DETAILED DESCRIPTION OF THE INVENTION

In carrying the invention into practice, techniques known to the art for the production of plaster molds may be employed. Thus, mixtures containing calcined gypsum, calcium sulfate hemihydrate, as the principal setting agent which have been slurried with water containing a wetting agent and stirred as with a propellor or turbine-type mixer or a perforated disc mixer to produce a smooth, pourable mix having myriads of small bubbles dispersed therethrough may be used to produce molds by pouring the plaster mix against a pattern. The mold resulting from setting of the plaster will have a system of interconnecting pores throughout and the plaster surface against the pattern will be smooth. The solidified plaster mix retains the bubble system present in the foamed slurry and it appears that the individual bubble cells become partially ruptured during the set so that interconnecting porosity results.

The slurry mix may contain other additives, extenders, strengtheners, set control agents, etc. Agents such as fine talc or silica strengthen the mold cavity surface during freezing of molten metal thereagainst. Fibrous materials such as asbestos (hydrated magnesium silicate) or wollastonite (hydrated calcium silicate) can be used to strengthen the mold. Additives such as boric acid, Portland cement, etc. may be used in small amounts. Retarders may also be used. Gypsum calcined under steam pressure (alpha-gypsum) may be employed.

The plaster mix must be stirred to form a slurry having a controlled small bubble size and poured against a pattern to form a mold before the mix becomes so stiff as to be unmanageable.

Prefoamed permeable plaster products based upon alpha-gypsum and foaming agents are available in the market. They include the product sold under the trademark HYDROPERM by the U.S. Gypsum Co., and the product sold under the trademark DENSECAL by Georgia-Pacific. A successful non-foamed plaster mix comprises 60 parts dense plaster, 28.85 parts talc, 10 parts wollastonite, 1 part boric acid and 0.15 part Portland cement. The water used in preparing the plaster slurry should be essentially free of iron; i.e., contain less than 600 ppm or preferably less than 60 ppm iron to prevent the possibility of a thermite type reaction when molten magnesium is poured in the calcined mold.

Once the permeable plaster mold is prepared it is then dehydrated to remove, first, the casual water and then the water of hydration so that the only calcium sulfate species remaining in the baked mold is anhydrite ($CaSO_4$). An oven with hot air circulation preferably is used, and heating is continued until the internal portions of the mold reach a minimum temperature of 410° F. for foamed plasters and of 450° F. for dense (non-foamed) plaster mixes. The actual oven temperature required to reach the desired mold temperature will, of course, be higher and will depend upon the permeability of the mold. Minimum heating times of at least 10 hours for molds made with permeable plaster and of at least 16 hours for molds made with dense plaster are employed. The calcined mold is fragile and must be handled carefully. Calcination further increases the porosity and permeability of the mold.

Even use of a fully calcined mold will not be enough to assure prevention of explosions when casting magnesium or a magnesium alloy. Accordingly, the inhibitor sulfur hexafluoride ($SF_6$) is used. Advantageously, the mold cavity is filled with pressurized gaseous $SF_6$ at a supply pressure between 10 and 35 psig, preferably 25 psig, and a flow of 30 standard cubic feet per hour (scfh) using a purge cup which fits tightly over the sprue. Pressurization is continued for a time sufficient to displace air from the pores in the mold area adjacent the mold cavity and fill the pores with gaseous $SF_6$. Pressurizing times of at least one to about five minutes are preferred.

Pressurized sulfur hexafluoride may be used, per se, or it may be diluted with $CO_2$ in proportions between 1 and 15 volume percent, preferably between 2 and 5 volume percent of $SF_6$ in carbon dioxide.

It is to be appreciated that the molten metal is cast into the mold as soon as possible after the calcination heat treatment so as to prevent recombination of mold ingredients with atmospheric moisture. This means that the $SF_6$ treatment is performed upon the hot mold. Preferably, the mold will still be at a temperature of at least 400° F. when metal is poured thereinto.

The use of pressurized $SF_6$ to infiltrate the pores in the mold adjacent the mold cavity is believed to exert a small positive pressure as the $SF_6$ heats from the heat of the mold and from the heat of the molten metal. This can minimize the carrying-in of air into the mold due to the action of the molten metal. Any low pressure areas within the mold cavity and the passages leading thereto created by oxidation of magnesium will be filled with $SF_6$ rather than fresh oxygen from the air. Also, any evolved water vapor will be diluted with $SF_6$ with some reaction producing $SO_2$ and HF which are not detrimental to magnesium casting surfaces. Any moisture in the interior of the mold would have to migrate to the hot metal surface against an expanding curtain of $SF_6$ gas.

As a final but essential precaution against explosions, a thermocouple is placed in the mold near the sprue and the heating pattern of the mold at the sprue interface is monitored as by a strip chart and an alarm system. The normal temperature pattern involves an initial temperature rise in response to insertion of hot molten metal into the mold, followed by a temperature fall-off with time. If there is an explosion potential due to reaction between the mold material and the molten metal there will be an exotherm indicated by a non-decreasing temperature pattern whereupon the alarm will sound and the mold may be broken to prevent explosion.

Examples will now be given. In each example, a thermocouple was placed in the flask about ¼ inch from the sprue and the plaster mix was cast therearound. The thermocouple was sufficiently close to the cast metal in the sprue that the cooling pattern of the metal after casting could be accurately monitored.

EXAMPLE 1

A plaster mix containing, by weight, 60% dense plaster, 28.85% talc, 10% wollastonite, 1% boric acid and 0.15% Portland cement was mixed dry for 10 minutes. The dry mix was formed into a slurry with water in proportion 1.8 parts water per 1.0 parts dry mix and the slurry was mixed for 8 minutes. Water temperature was 80°-85° F. The slurry was poured against a polyurethane pattern of a computer component face and allowed to set, thus forming a two-part mold. The mold was calcined at 600° F. for 16 hours whereupon a permeability of about 1* or higher resulted using the standard Permmeter test. While the mold was still hot from calcining, the mold cavity was pressurized with a gas mixture containing about 4 volume percent of $SF_6$ in carbon dioxide for about 3 minutes at a supply pressure of 25 psig and flow rate of 30 scfh. Molten magnesium of commercial purity was then poured into the hot mold and a casting with smooth attractive surface resulted. Temperature monitoring based on readings from the thermocouple demonstrated no abnormal behavior.

* Permeability of 1 corresponds to approximately 0.2 grams $H_2O/CM^2$ differential pressure (7 mm. $H_2O$).

EXAMPLE 2

The procedure of Example 1 was repeated using a permeable foam plaster mix HYDROPERM. The plaster was mixed with low-iron water at a temperature of 80°-85° F. in a 1 to 1 ratio to form a slurry. Mixing continued to a foam growth of 25%, and the slurry was poured against a polyurethane pattern to form a mold. The mold was calcined at 450° F. for 10 hours at which point it had a permeability of about 4 on the standard Permeability scale. The mold was purged with pressurized $SF_6$ at 25 psig supply pressure and 30 scfh flow for 4 minutes and a successful magnesium alloy (AZ91) casting was made in the hot mold. Again, monitoring of the mold temperature during cooling of the cast metal showed no abnormalities in mold cooling behavior.

The term "magnesium alloys" as used herein refers to alloys containing 85% or 87% or 90% or more of magnesium with minor amounts of aluminum, zinc, manganese, etc. Such alloys are generally stronger when cast than is pure magnesium. The invention is particularly applicable to casting magnesium and magnesium alloys having a section size of at least about ⅛ inch and up to abount 4 or 5 inches or more.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The method for producing castings made of metal from the group consisting of magnesium and magnesium alloys in porous, calcined plaster molds which comprises the steps of (1) preparing a plaster mold having a sprue and a mold cavity, (2) calcining said plaster mold to remove casual water and all water of hydration associated with said plaster, said calcined mold having a system of interconnecting pores therethrough, (3) pressurizing said mold cavity while said calcined mold is still hot from said calcination with an inhibitor gas from the group consisting of sulfur hexafluoride and a gas mixture of carbon dioxide with about 1% to about 15%, by volume of sulfur hexafluoride to fill at least said mold cavity and the mold pores in the vicinity of said mold cavity with said inhibitor gas, (4) casting molten metal from the group consisting of magnesium and magnesium alloys into said hot mold cavity containing said inhibitor gas and (5) monitoring the mold temperature from a point close to the sprue during cooling of the cast metal in the mold whereby the mold can be broken in the event of an exotherm to prevent explosion.

2. The method of claim 1 wherein said mold cavity is pressurized to a pressure of about 10 to about 35 psig.

3. The method of claim 1 wherein substantially all the pores of said calcined mold are filled with said inhibitor.

4. The method of claim 1 wherein the means for accomplishing said mold temperature monitoring comprises a thermocouple located in the mold close to the sprue.

5. The method of claim 5 wherein said thermocouple is connected to an alarm which sounds in the event of a non-decreasing temperature.

* * * * *